US006976620B2

(12) United States Patent
Swider

(10) Patent No.: US 6,976,620 B2
(45) Date of Patent: Dec. 20, 2005

(54) MAIL LIMITING DEVICE

(75) Inventor: John T. Swider, Port Crane, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/400,047

(22) Filed: Mar. 26, 2003

(65) Prior Publication Data

US 2003/0209596 A1 Nov. 13, 2003

Related U.S. Application Data

(60) Provisional application No. 60/368,060, filed on Mar. 26, 2002.

(51) Int. Cl.[7] ..... B65G 11/04
(52) U.S. Cl. ..... 232/45; 232/47; 232/52
(58) Field of Search ..... 232/45, 47, 52, 232/54, 17, 49–51

(56) References Cited

U.S. PATENT DOCUMENTS

| | | | | |
|---|---|---|---|---|
| 359,548 A | | 3/1887 | Scoville | |
| 429,986 A | | 6/1890 | Wiegand | |
| 560,477 A | * | 5/1896 | Gaschlin | 232/50 |
| 561,589 A | * | 6/1896 | Cook | 232/49 |
| 570,628 A | * | 11/1896 | Hower | 232/49 |
| 652,916 A | * | 7/1900 | Kline | 232/51 |
| 659,486 A | | 10/1900 | Mulloy | |
| 787,731 A | * | 4/1905 | Dickson | 232/47 |
| 1,086,206 A | | 2/1914 | Otto | |
| 1,140,914 A | | 5/1915 | Ostachowski | |
| 1,141,806 A | | 6/1915 | Loudenslager | |
| 2,437,319 A | | 3/1948 | Gable et al. | |
| 2,829,820 A | | 4/1958 | Evers | |
| 3,519,198 A | | 7/1970 | Benoliel | |
| 3,976,345 A | | 8/1976 | Walters | |
| 4,069,965 A | | 1/1978 | Maddox, Jr. | |
| 4,333,603 A | | 6/1982 | Carlson | |
| 4,545,522 A | | 10/1985 | Kerzner | |
| 4,724,999 A | | 2/1988 | Fitzgerald et al. | |
| 4,895,300 A | | 1/1990 | Hammons et al. | |

(Continued)

FOREIGN PATENT DOCUMENTS

JP 09173202 7/1997

OTHER PUBLICATIONS

U.S. Appl. No. 09/809,503, filed Mar. 15, 2001, Webb.

(Continued)

*Primary Examiner*—William L. Miller
(74) *Attorney, Agent, or Firm*—Perkins Smith Cohen LLP; Harvey Kaye; Jacob Earlich

(57) ABSTRACT

A device for limiting the size and shape of mail which may be deposited into a mail drop box. The box includes an enclosure having a deposit port at its upper end of a predetermined size and shape, and a collection chamber below the deposit port. There is a pivotal door having at most substantially the same size and shape as the deposit port and closing the deposit port when the door is in a first, closed position and opening the deposit port when the door is in a second, open position. A plate is disposed in the enclosure between the deposit port and the collection chamber of a substantially similar size and shape as the deposit port and having a restricted size opening and located to be exposed when the pivotal door in the open position to restrict the size of the deposit port to the restricted size opening.

21 Claims, 8 Drawing Sheets

U.S. PATENT DOCUMENTS

| | | | | |
|---|---|---|---|---|
| 5,056,711 | A | 10/1991 | Bush | |
| 5,143,284 | A | 9/1992 | Socarras | |
| 5,333,782 | A | 8/1994 | Frauenberger | |
| 5,346,086 | A | 9/1994 | Harris | |
| 5,368,226 | A | 11/1994 | Franceschino | |
| 5,400,960 | A | 3/1995 | Jeffs | |
| 5,454,332 | A | 10/1995 | Fennelly et al. | |
| 5,482,208 | A * | 1/1996 | Johnston | 232/47 |
| 5,597,116 | A | 1/1997 | Morris | |
| 5,617,993 | A | 4/1997 | Morris | |
| 5,624,071 | A | 4/1997 | Sosan | |
| 5,897,053 | A | 4/1999 | Cirimele | |
| 5,938,113 | A | 8/1999 | Kim | |
| 5,979,751 | A | 11/1999 | Maddox | |
| 5,992,736 | A | 11/1999 | Parker | |
| 6,234,388 | B1 | 5/2001 | Taylor | |
| 6,299,061 | B1 | 10/2001 | Henson | |
| 6,318,628 | B1 | 11/2001 | Pangburn | |
| 6,375,071 | B1 | 4/2002 | Kim | |
| 6,588,656 | B2 * | 7/2003 | Cox et al. | 232/47 |
| 6,644,542 | B2 * | 11/2003 | Cox et al. | 232/47 |
| 6,742,703 | B2 | 6/2004 | Esakov et al. | 232/45 |
| 2002/0014525 | A1 | 2/2002 | Webb | |
| 2003/0019921 | A1 | 1/2003 | Cox et al. | |
| 2003/0222132 | A1 | 12/2003 | Esakov et al. | 232/30 |

OTHER PUBLICATIONS

U.S. Appl. No. 10/065,412, filed Oct. 16, 2002, Cox et al.

U.S. Postal Service Emergency Preparedness Plan for Protecting Postal Employees and Postal Customers from Exposure to Biohazardous Material and for Ensuring Mail Security Against Bioterror Attacks; Mar. 6, 2002; published by USPS.

* cited by examiner

MAIL LIMITING DEVICE

CROSS REFERENCE TO RELATED APPLICATIONS

The present application claims the benefit of U.S. Provisional Patent Application No. 60/368,060 filed Mar. 26, 2002 entitled MAIL LIMITING DEVICE, which is incorporated herein by reference.

FIELD OF THE INVENTION

This invention relates generally to the protection of mail handlers from hazardous material contained in letters or mail parcels, and, more particularly, to a limiting means to deter the placement of such hazardous material or nuisance objects into the collection boxes of the mail system.

BACKGROUND OF THE INVENTION

Incidents of anthrax laced letters being transported through the United States Postal Service (USPS) facilities to unsuspecting recipients has increased awareness of the potential for terrorists and other criminals to use the mail system as a delivery mechanism for large scale introduction of biologics, chemicals, explosives, and other hazardous materials to create chaos or to harm an intended set of victims. There appears to be no current security devices or procedures that are available to provide a limiting means to deter use of the mail system as a way to deliver harmful materials, especially during the initial phases of mail handling or processing. The same deterrent means could be utilized to prevent the placement of nuisance objects, such as soda and beer cans, bottles, or rocks, from being placed in the collection box.

The current opening size for depositing mail into the typical collection box located on a street corner is about 6 inches by 15 inches. Most mail deposited into such a collection box comprise business size envelopes, which are approximately 4⅛ inches by 9½ inches, or smaller sized envelopes. Therefore, the current opening size is larger than required for most, if not all, mail deposited with the postal system through collection boxes. Use of a smaller sized opening would restrict the size of object which could be deposited into the collection boxes.

U.S. Pat. No. 659,486, issued Oct. 9, 1900, to W. H. Mulloy, discloses a mail box having stationary projecting guides with suitable incline for an article to pass therethrough into the mail box and a pivotal cover that covers the stationary projecting guides when in the closed position and exposes the stationary projecting guides when in the open position.

U.S. Pat. No. 5,368,226, issued Nov. 29, 1994, to L. Franceschino, discloses a planar frame element for framing an interior opening of the mail slot.

SUMMARY OF THE INVENTION

The present invention is a device for limiting the size and shape of mail which may be deposited into a mail drop box. The drop box includes an enclosure having a deposit port at its upper end and of a predetermined size and shape, and a collection chamber below the deposit port. There is a pivotal door having at most substantially the same size and shape as the deposit port and closing the deposit port when the door is in a first, closed position and opening the deposit port when the door is in a second, open position. A plate is disposed in the enclosure between the deposit port and the collection chamber and of a substantially similar size and shape as the deposit port and having a restricted size opening and located to be exposed when the pivotal door in the open position to restrict the size of the deposit port to the restricted size opening. The door and the plate may be attached to each other at an angle so that as the door is moved to the open position, the restricted size opening in the plate closes the deposit port and prevents objects from being placed into the drop box that do not fit through the restricted size opening. The plate may include a first planar portion having the restricted size opening and a second portion adapted for affixing the plate to the drop box and the plate may be adapted for affixing to the pivotal door or to the enclosure.

The present invention includes a shaped member having two planar elements. The shaped member may be formed from one plate bent to a predetermined angle $\alpha$ or comprised of two plates conventionally joined along one edge forming the predetermined angle $\alpha$. One planar element includes an aperture of a size designed to accept the maximum mail piece size desired for deposit into the collection box. The planar element is preferably of a size slightly larger than the opening (about 6 inches by 15 inches) in the collection box such that when the door of the collection box is opened the aperture is the only opening for mail to be deposited into the collection box. The mail limiting device is conventional joined to the collection box door or door counterbalance plate.

For a better understanding of the present invention reference is made to the accompanying drawings and detailed description.

DETAILED DESCRIPTION OF THE PREFERRED EMBODIMENTS

Figure 1:
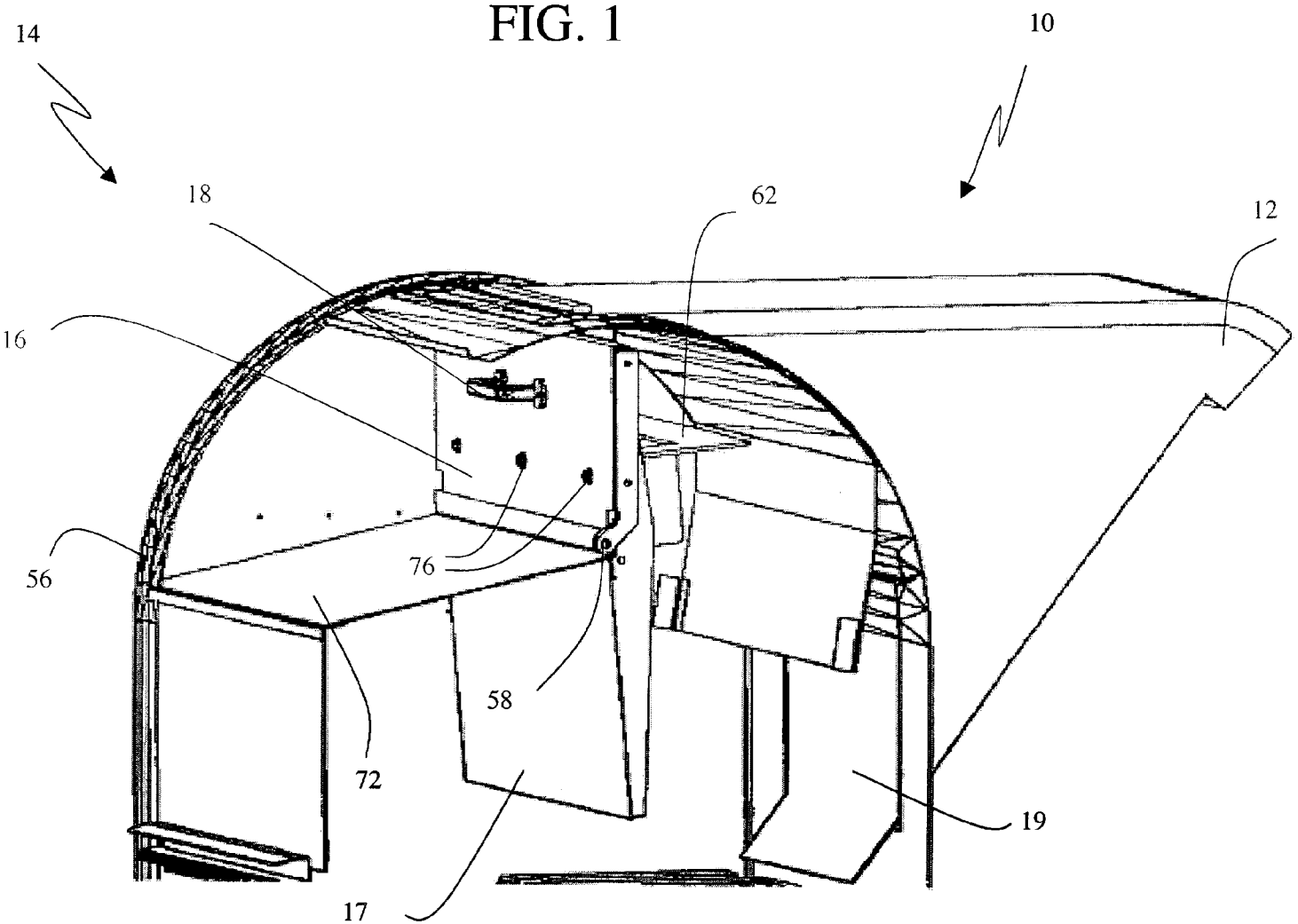
FIG. 1 is a schematic, isometric view of the upper portion of a collection drop box showing the present invention when the collection box is not in use.
Figure 2:
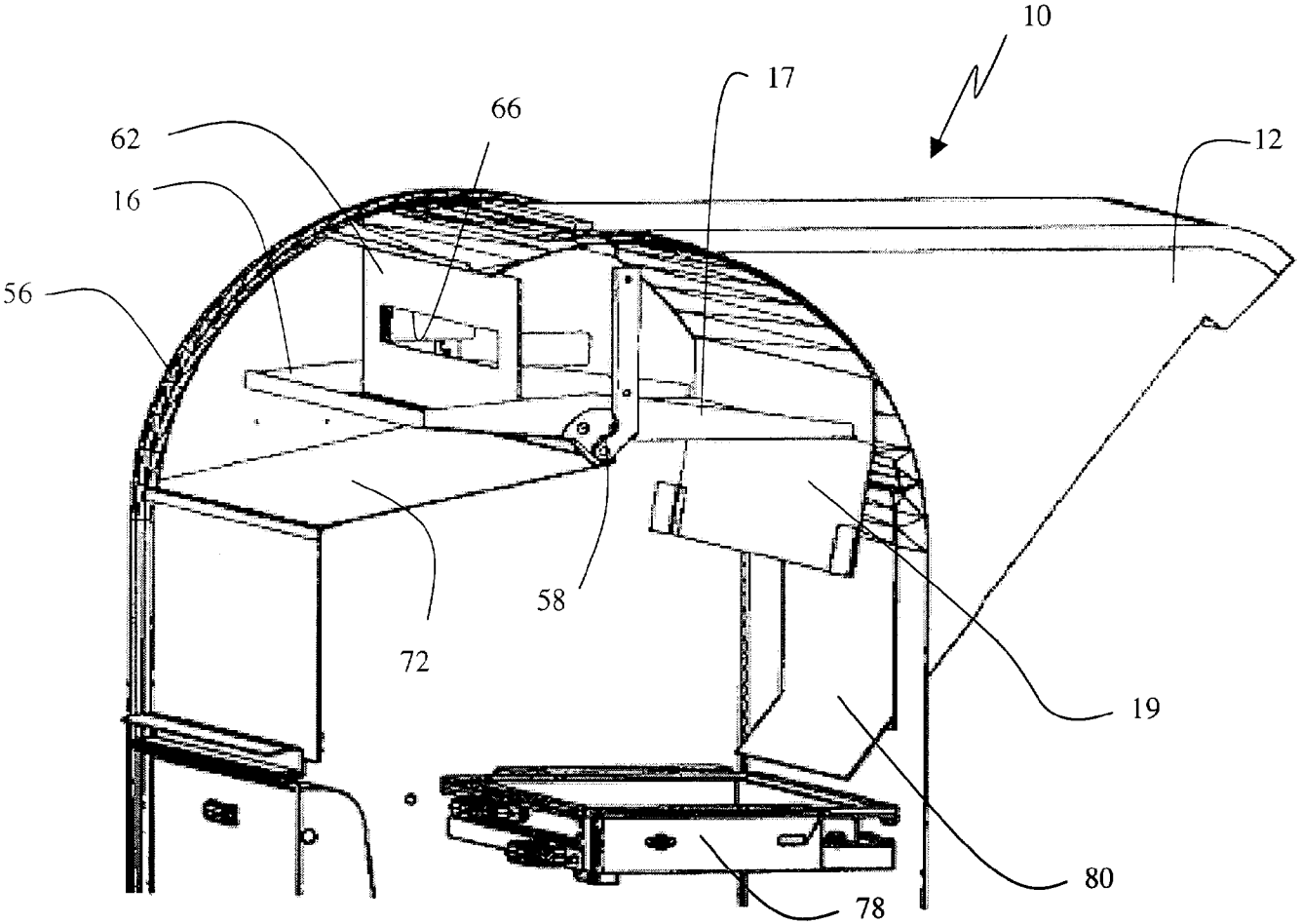
FIG. 2 is a schematic, isometric view of the upper portion of a collection drop box showing the present invention when the collection box is in use.
Figure 3:
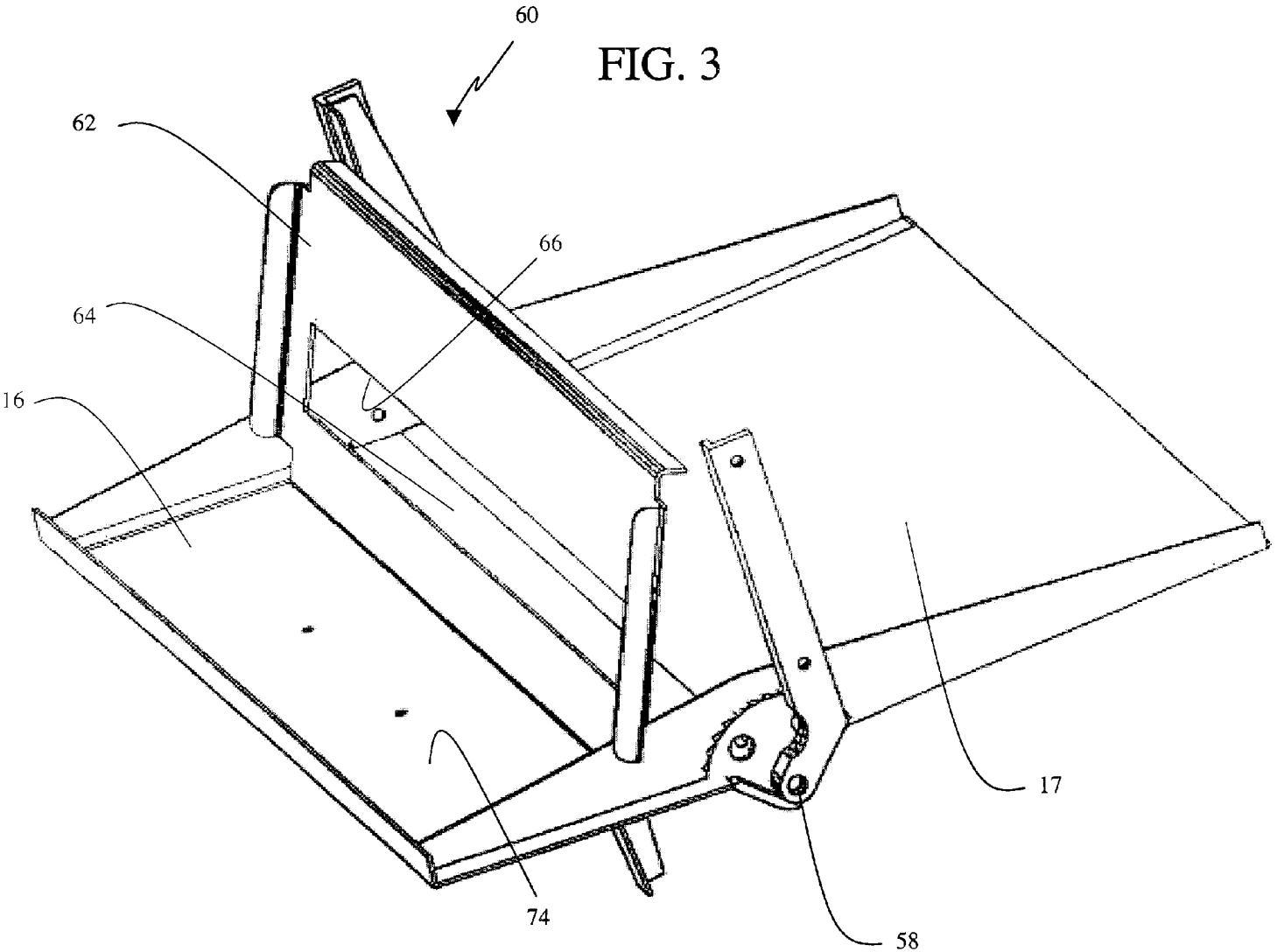
FIG. 3 is an isometric view of the mail limiting device of the invention mounted on a door of a collection drop box.

Referring to FIGS. 1 and 2, a collection or drop box 10 is shown which has an inlet 12 on one side having an opening through which mail can be deposited. On the other side there is a deposit port 14 having a pivoted door 16 and a handle 18. The box has an enclosure 56. The door 16 is pivotally connected to structure 72 inside the box enclosure by a hinge 58. The opening of the deposit port 14 is fully covered by door 16 when the deposit port 14 of the collection box is not in use. The mail limiting device 60 of the present invention, in this embodiment, includes a plate 62 and a mounting flange 64. The actual limiting element is opening 66 which determines the size, and, to a more or less extent, the shape, of mail which may pass therethrough. A mail collecting container 78 us shown in FIG. 2.

Figure 6:
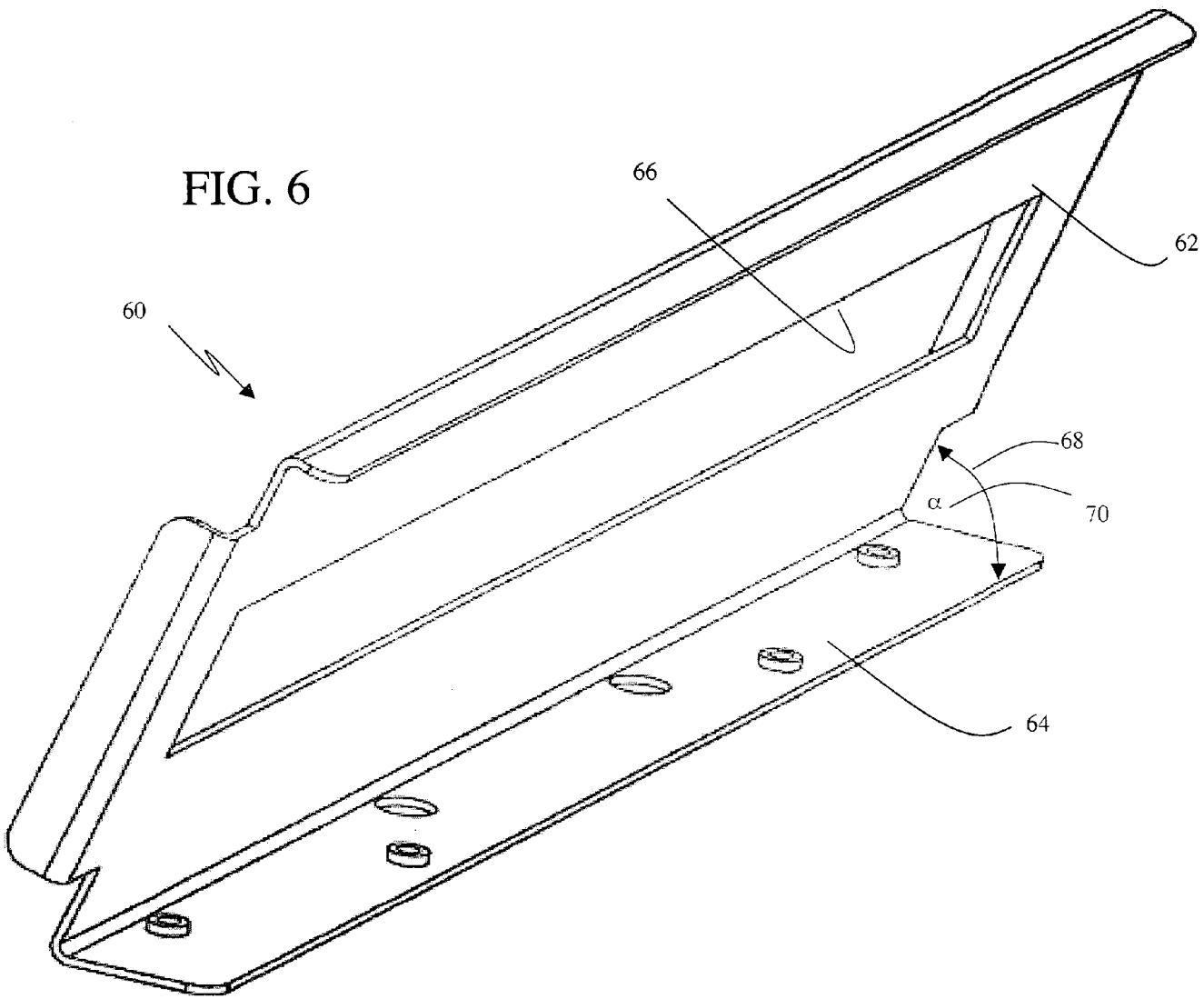
FIG. 6 is an isometric view of the mail limiting device shown in FIGS. 1–3.

FIG. 6 shows the details of the mail limiting device 60 indicating there is an angle α as indicated by double arrowed line 68 between the plate 62 and the mounting flange 64. The angle α may be in the range of about 75 degrees to about 105 degrees. The plate 62 and flange 64 may be formed from a single piece which is bent, or can be two plates joined together by means such as welding, brazing, soldering or the like along one edge to form the predetermined angle α. Other angles may be acceptable depending upon the drop box on which the mail limiting device is being used.

In determining the appropriate angle α for a given collection box, one of ordinary skill in the art will account for combined effects of mail limiting device being attached to the door of the collection box door, such as, for example, total weight, balance, and rotational limitations (e.g., obstructions) of the door. The shaped member 60 is preferably make of material (such as metal, composites, polymers, or wood) compatible with the door 16 for joining purposes.

One embodiment of the plates forming the plate 62 and flange 64 is shown as rectangular, but any geometric shape is acceptable. Plate 62 includes opening or aperture 66 of a size designed to accept the maximum mail piece size desired for deposit into the collection box 10. Most mail deposited into such a collection box include, for example, business size envelopes, which are approximately 4⅛ inches by 9½ inches, or smaller sized envelopes. However, if desired an aperture 66 can be shaped to accommodate any size letter or parcel. The aperture 66 is shown as rectangular, but any geometric shape is acceptable. Plate 62 is preferably of a size slightly larger than the opening (about 6 inches by 15 inches) of the deposit port 14 in the collection box 10 such that when the door 16 of the collection box 10 is opened the aperture 66 is the only opening for mail to be deposited in the collection box 10 as shown in FIG. 2. The flange 64 of plate 62 is preferably attached to the rear surface 74 of the door 16 by conventional joining means, such as bolts 76 shown in the drawing, or screws, adhesive, or welding, brazing, or soldering or the like.

In operation, door 16 is pulled open by the customer, as shown in FIG. 2, to deposit mail into the collection box 10. The downward motion of the door 16 results in the upward motion of plate 62 and of the door extension 17 until the plate covers the opening of the deposit port 14 of the collection box 10, except for opening 66. The door extension 17 moves closely adjacent to screen wall 19 inside box 10 which assures that mail will be directed into container 78. Deposit of the mail may now only occur through opening 66 thereby limiting the size of the item that may be deposited within the collection box 10.

In this manner, business-sized envelopes for example, which is the majority type of mail deposited in a typical corner collection box, can be easily deposited in a collection box fitted with the present invention, but larger items will not be able to be deposited. There is a chute 80 which directs mail deposited into inlet 12 into container 78.

The inlet 12 at the other side from deposit port 14 is arranged for deposits of mail from a vehicle, and a suitable plate 62 will usually also be placed inside of inlet 12 when mail limiting is also desired for the inlet.

Figure 4A:
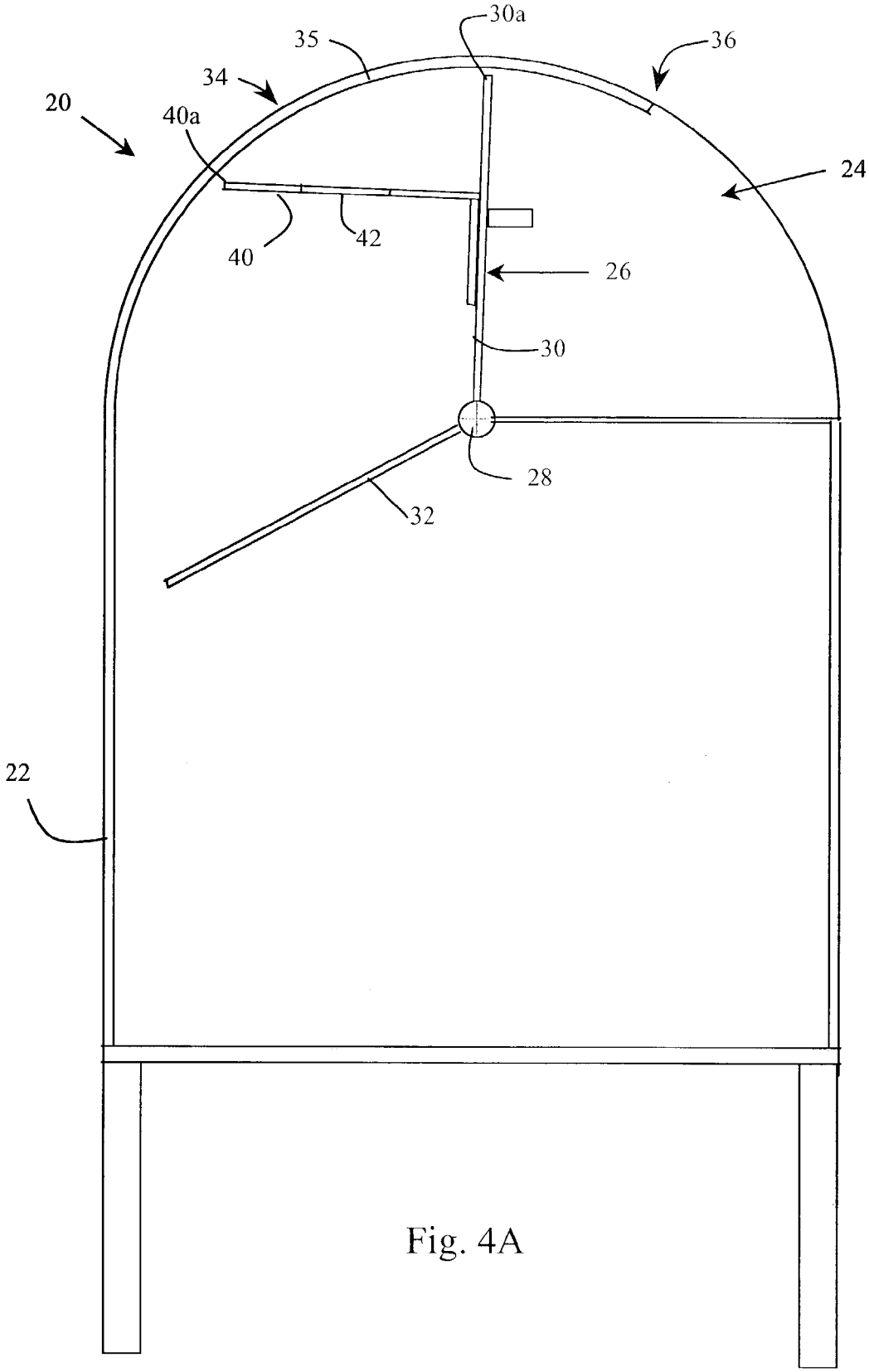
FIGS. 4A, 4B and 4C are schematic side views of other embodiments of the invention.
Figure 4B:
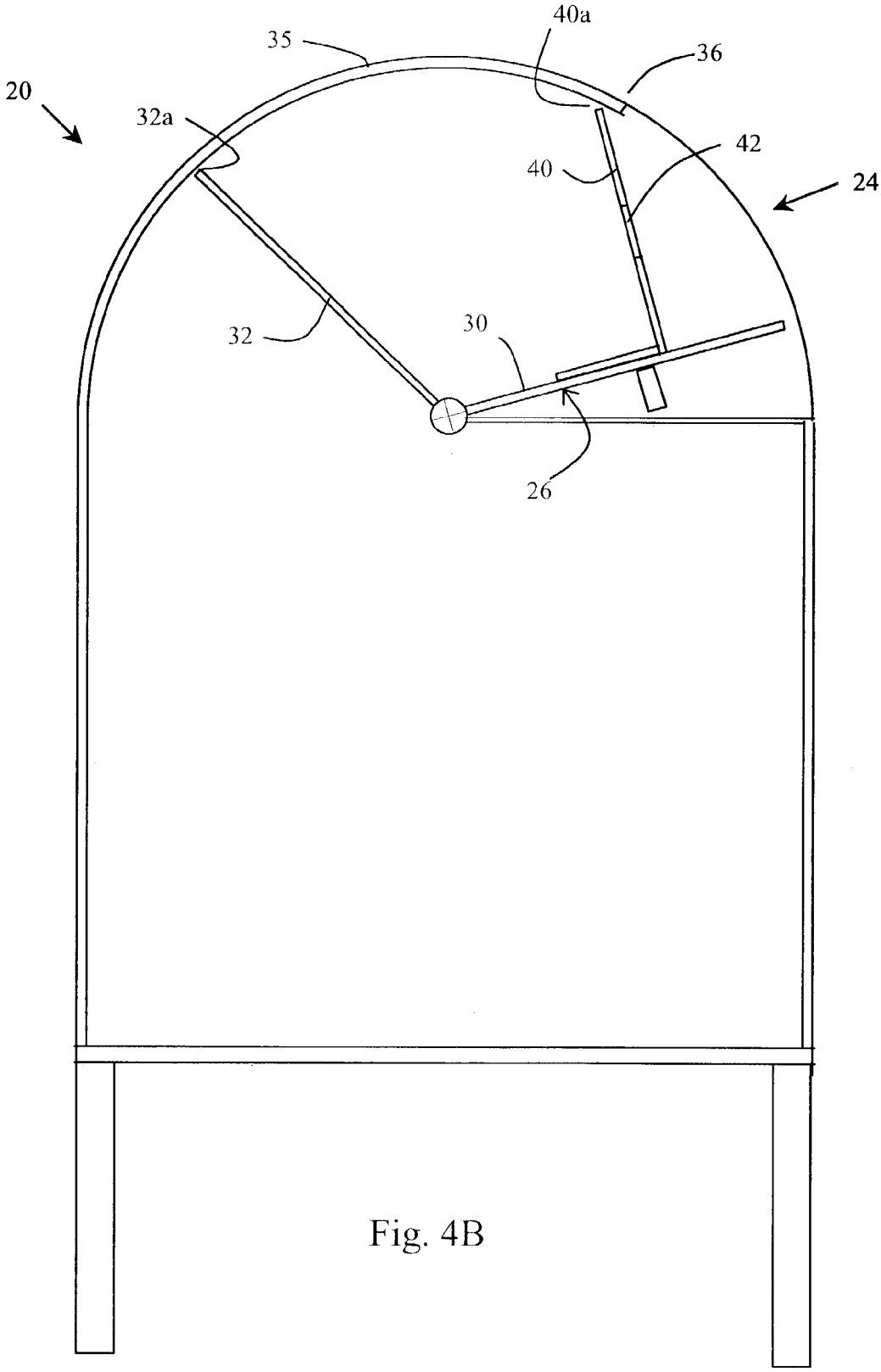
Figure 4C:
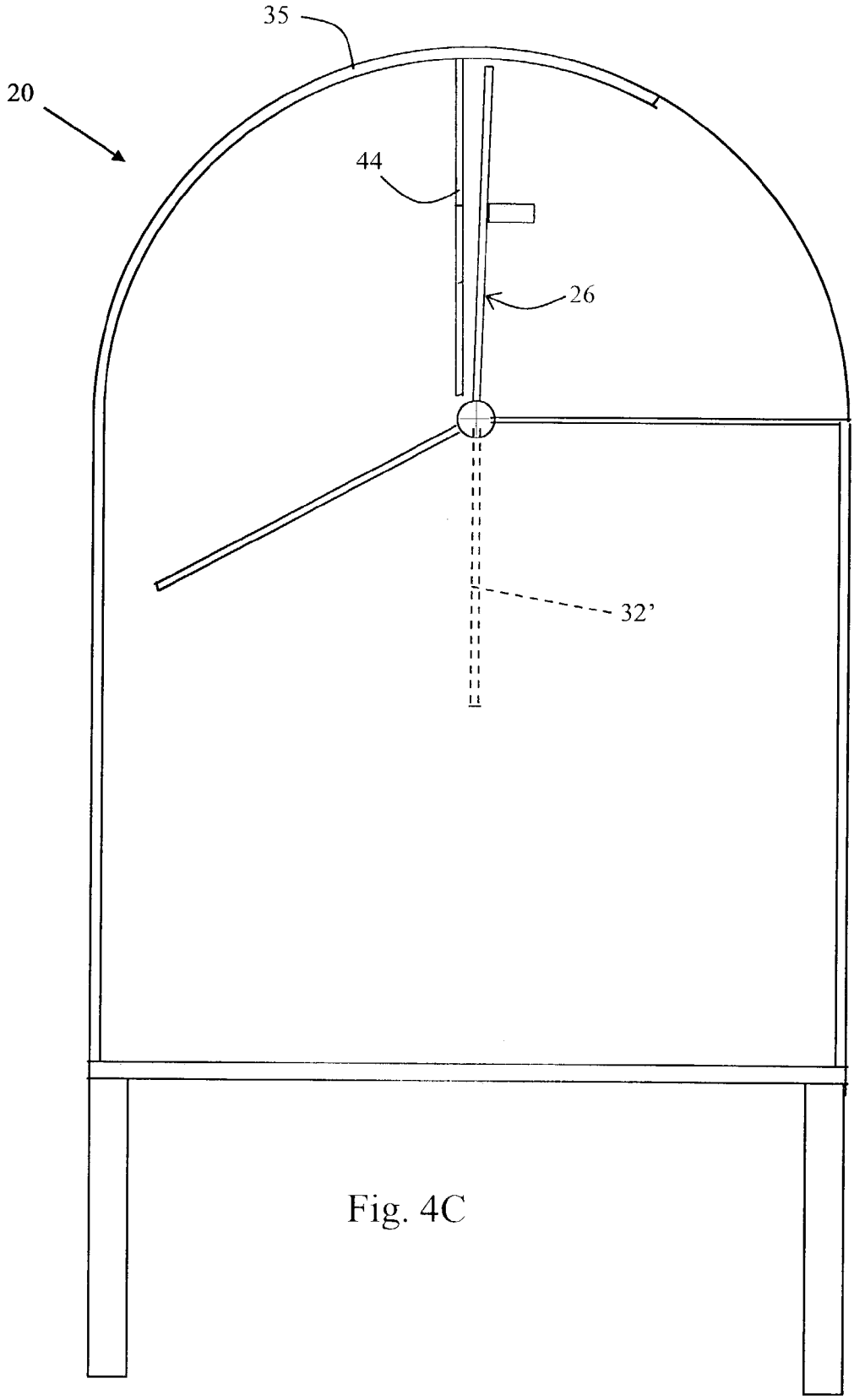

FIGS. 4A, 4B and 4C are exposed side views of a drop box 20 constructed in accordance with another embodiment of the present invention. Drop box 20 generally includes an enclosure 22 and a depository port 24. Depository port 24 is closed by a rotatable door 26, which is rotatable about a horizontally oriented axis 28. Door 26 generally includes a pair of planar portions 30, 32 that are attached to each other along the axis of rotation 28. As shown in dashed lines in FIG. 4C the door planar portion 32 can be attached, as at 32', so that the door and its extension can be connected at an angle of 180 degrees and can be a single piece. Drop box 20 includes a top 34 that is shaped like a hemispherical surface of rotation with respect to and around axis 28. Top 34 is open clockwise from point 36 to form depository port 24 and is enclosed along portion 35, counter-clockwise from point 36, as part of the enclosure of drop box 20.

Planar portions 30, 32 of door 26 are angled with respect to each other to control the movement of deposited items dropped into a drop box 20. Planar portion 30 is sized to have a distal edge 30*a* located proximally to closed portion 35 of top 34. Distal edge 30*a* remains proximal to the hemispherical shape of top 34 throughout the angle of rotation of door 26. This proximity helps prevent the placement of items into drop box 20 before door 26 and planar portion 30 are rotated clockwise and distal edge 30*a* clears point 36. At the angle of rotation of door 26 represented by point 36, planar portion 32 is angled to have a distal edge 32*a* located in proximity to the hemispherical shape of top 34. Planar portion 32 is sized to maintain distal edge 32*a* in proximity to closed portion 35 of top 34 while door 26 is rotated clockwise past point 36 to allow the deposition of items. This proximal relationship prevents deposited items from being passed around planar portion 32 while depository port 24 is open.

Drop box 20 further includes a plate 40 having a restricted size opening 42 similar to the previously described devices herein, which plate 40 is exposed through depository port 24 in the open position of door 26, as shown in FIG. 4B. Plate 40 is shown affixed to planar portion 30 of door 26 and is sized to have a distal edge 40*a* which remains in proximity to closed portion 35 of top 34 throughout the angle of rotation of door 26. This prevents items from being pushed past plate 40 except through restricted size opening 42. Although plate 40 is shown affixed to pivotable door 26, it may also be suitably affixed to top 34 and sides of drop box 20, as shown for plate 44 in FIG. 4C.

Figure 5:
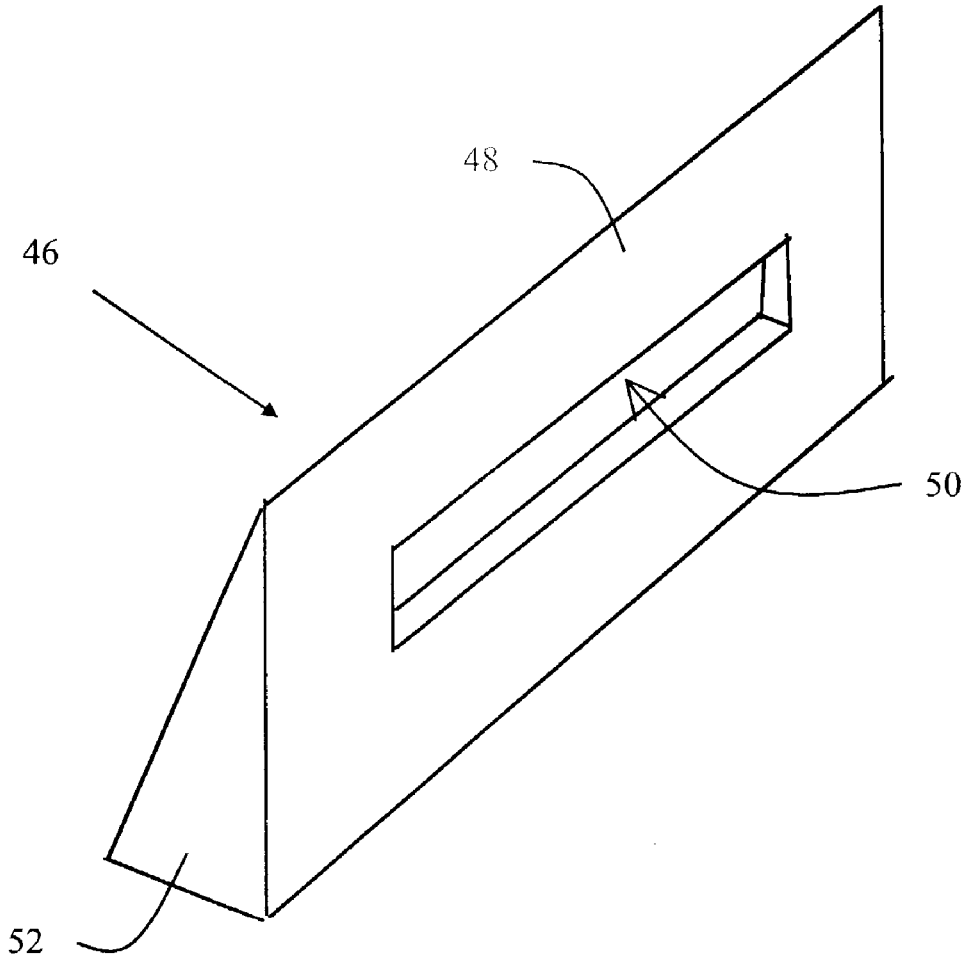
FIG. 5 is an isometric view of another embodiment of the size limiting panel.

FIG. 5 is a perspective view of another embodiment of plate 46 and includes a planar portion 48 containing restricted size opening 50 and a pair of triangular end portions 52, which serve to attach plate 46 to pivoted door 26 or top portion 35 of drop box 20. Triangular portions 52 provide plate 46 with greater angular stiffness thus helping to prevent bending of plate 46 by misuse.

Thus, the present invention provides a simple mail limiting device which can be a formed piece with a slot size designed to accept the maximum mail piece size that is desired, the mail limiting device can be securely attached to the mail drop door's inner surface on currently used mail boxes. When the customer opens the door by pulling the existing handle, he has only one option for inserting the mail. Through the provided slot in the mail limiting device. Most mail pieces inducted into a corner collection box are business size envelopes 4⅛" by 9" or smaller. Occasionally an 8½ by 11" envelope may be inducted. The USPS can dictate the slot size but the fact remains that it is currently too large. An added benefit of the device is that it will help reduce mail jams and direct mail more centrally into other future hardware that may be fitted to the collection boxes in the current contamination/containment efforts.

Although the invention has been described with respect to various embodiments, it should be realized this invention is also capable of a wide variety of further and other embodiments within the spirit and scope of the present invention.

What is claimed is:

1. A drop box, comprising:

an enclosure having a deposit port at its upper end and of a predetermined size and shape and a collection chamber below said deposit port;

a pivotal door having at most substantially the same size and shape as said deposit port and closing said deposit port when the door is in a first, closed position and opening said deposit port when the door is in a second, open position, a plate disposed in said enclosure between said deposit port and said collection chamber and of a substantially similar size and shape as said deposit port and having a restricted size opening and located to be exposed when said pivotal door in said open position to restrict the size of said deposit port to said restricted size opening means for attaching said plate to the inside of said door.

2. A drop box, comprising:

an enclosure having a deposit port at its upper end and of a predetermined size and shape and a collection chamber below said deposit port;

a pivotal door having at most substantially the same size and shape as said deposit port and closing said deposit port when the door is in a first, closed position and opening said deposit port when the door is in a second, open position, a plate disposed in said enclosure between said deposit port and said collection chamber and of a substantially similar size and shape as said deposit port and having a restricted size opening and located to be exposed when said pivotal door in said open position to restrict the size of said deposit port to said restricted size opening, said plate including a first planar portion having said restricted size opening and a second portion adapted for affixing said plate to said drop box, and wherein said door and said plate are attached to each other at an angle so that as said door is moved to said open position, the restricted size opening in said plate closes the deposit port and prevents objects from being placed into the drop box that do not fit through the restricted size opening.

3. A drop box comprising:

an enclosure having a deposit port at its upper end and of a predetermined size and shape and a collection chamber below said deposit port;

a pivotal door having at most substantially the same size and shape as said deposit port and closing said deposit port when the door is in a first, closed position and opening said deposit port when the door is in a second open position, a plate disposed in said enclosure between said deposit port and said collection chamber and of a substantially similar size and shape as said deposit port and having a restricted size opening and located to be exposed when said pivotal door in said open position to restrict the size of said deposit port to said restricted size opening, said plate including a first planar portion having said restricted size opening and a second portion adapted for affixing said plate to said drop box, and wherein said plate is adapted for affixing to said pivotal door.

4. The drop box of claim 2, wherein said plate is adapted for affixing to said enclosure.

5. The drop box of claim 4, wherein said restricted size opening is of substantially lesser dimensions than said plate.

6. The drop box as defined in claim 4 wherein said restricted size opening is always open.

7. A drop box as defined in claim 2, wherein said restricted size opening is of substantially smaller dimensions than said plate.

8. A drop box comprising:

an enclosure having a deposit port at its upper end and of a predetermined size and shape and a collection chamber below said deposit port;

a pivotal door having at most substantially the same size and shape as said deposit port and closing said deposit port when the door is in a first, closed position and opening said deposit port when the door is in a second, open position, a plate disposed in said enclosure between said deposit port and said collection chamber and of a substantially similar size and shape as said deposit port and having a restricted size opening and located to be exposed when said pivotal door in said open position to restrict the size of said deposit port to said restricted size opening, said plate including a first planar portion having said restricted size opening and a second portion adapted for affixing said plate to said drop box, and wherein said restricted size opening is always open.

9. A drop box, comprising:

an enclosure having a deposit port at its upper end and of a predetermined size and shape and a collection chamber below said deposit port;

a pivotal door having at most substantially the same size and shape as said deposit port and closing said deposit port when the door is in a first, closed position and opening said deposit port when the door is in a second, open position, a plate disposed in said enclosure between said deposit port and said collection chamber and of a substantially similar size and shape as said deposit port and having a restricted size opening and located to be exposed when said pivotal door in said open position to restrict the size of said deposit port to said restricted size opening, said pivotal door comprises a first planar portion adapted for closing and opening said deposit port and a second planar portion adapted for forming said bottom portion of said collection chamber, and further wherein said first and second planar portions are affixed to each other along a horizontally oriented axis of rotation for said pivotal door.

10. The drop box of claim 9, wherein said enclosure has a top shaped like a hemispherical surface of rotation with respect to the axis of rotation of said pivotal door, and further wherein said plate is affixed to said door with an outer most edge thereof located proximally to said surface of rotation to prevent items from passing said plate except through said restricted size opening.

11. An object size limiting drop box comprising:

a drop box housing;

a deposit port near or at the upper end of the housing;

a collection chamber in said housing disposed below said deposit port;

a pivotal door for opening and closing said deposit port;

a first planar member and a second planar member joined together forming a predetermined angle therebetween and located in said deposit port; and an aperture disposed in said first planar member, said aperture sized always opened and to prohibit passage therethrough of objects larger than desired.

12. The drop box of claim 11, wherein said aperture dimensions are substantially smaller than the dimensions of said first planar member.

13. A drop box as defined in claim 12 wherein said planar members are rectangular shaped.

14. A drop box as defined in claim 12 wherein said predetermined angle ranges approximately from 75 degree to 105 degrees.

15. A drop box as defined in claim 12 wherein said first planar member is sized to cover the deposit port.

16. A drop box as defined in claim 12 wherein said second planar member is attached to the housing in juxaposition to said deposit port.

17. A drop box as defined in claim 11 wherein said planar members are rectangular shaped.

18. A drop box as defined in claim 11 wherein said predetermined angle ranges approximately from 75 degree to 105 degrees.

19. A drop box as defined in claim 11 wherein said first planar member is sized to cover the deposit port.

20. A drop box as defined in claim 11 wherein said second planar member is attached to the housing in juxaposition to said deposit port.

21. A retrofit assembly for a drop box having a drop box housing, a deposit port near or at the upper end of the housing having a door which may be opened to deposit mail, and a collection chamber in the housing and disposed below the deposit port, the assembly being a mail size limiting device comprising:

a shaped element having two elongated members, said members being angularly positioned from each other between about 75 degrees to about 105 degrees;

an aperture disposed in one of said members, said aperture sized to prohibit passage therethrough of objects larger than desired; and said shaped element being adapted to be attached to the drop box housing in the vicinity of the deposit port, means for attaching said mail size limiting device to the inside of the drop box deposit port door, whereby mail deposited into the deposit port passes through said aperture, thereby limiting mail entry into the drop box by the geometric configuration of said aperture.

* * * * *

UNITED STATES PATENT AND TRADEMARK OFFICE

CERTIFICATE OF CORRECTION

PATENT NO. : 6,976,620 B2
APPLICATION NO. : 10/400047
DATED : December 20, 2005
INVENTOR(S) : John T. Swider It is certified that error appears in the above-identified patent and that said Letters Patent is hereby corrected as shown below:

Claim 3, lines 8-9 (column 5, lines 51-52), "second open position" should read --second, open position--

Claim 8, line 1, (column 6, line 6), "A drop box comprising:" should read --A drop box, comprising:--

Claim 11, line 11 (column 6, line 65), "aperture sized always opened and to" should read --aperture always open and sized to--

Signed and Sealed this

First Day of September, 2009

David J. Kappos

David J. Kappos
*Director of the United States Patent and Trademark Office*